US005682831A

United States Patent [19]

Yokoi

[11] Patent Number: 5,682,831

[45] Date of Patent: Nov. 4, 1997

[54] WATER SURFACE GLIDE SAILBOAT UTILIZING WIND POWER PROPELLING

[76] Inventor: Tatsuro Yokoi, 5-5, Shinjuku 1-chome, Zushi-shi, Kanagawa-ken, Japan

[21] Appl. No.: 795,358

[22] Filed: Feb. 4, 1997

Related U.S. Application Data

[63] Continuation of Ser. No. 631,905, Apr. 12, 1996, abandoned, which is a continuation of Ser. No. 325,792, Oct. 19, 1994, abandoned.

[51] Int. Cl.[6] ..... B63B 1/14

[52] U.S. Cl. ..... 114/39.1; 114/61; 114/123

[58] Field of Search ..... 114/39.1, 61, 123, 114/283

[56] References Cited

U.S. PATENT DOCUMENTS

| | | | |
|---|---|---|---|
| 603,469 | 5/1898 | Kautz | 114/283 |
| 3,509,842 | 5/1970 | Mitchell | 114/39.1 |
| 3,566,819 | 3/1971 | Keddie | 114/39.1 |
| 3,696,772 | 10/1972 | Sundelin | 114/39.1 |
| 3,841,251 | 10/1974 | Larson | 114/39.1 |
| 4,401,047 | 8/1983 | Auras | 114/39.1 |
| 4,408,772 | 10/1983 | Hollwarth | 114/61 |
| 4,688,504 | 8/1987 | Sulz et al. | 114/39.1 |
| 4,757,777 | 7/1988 | Rosenberger | 114/61 |
| 4,890,570 | 1/1990 | Hofmeister | 114/61 |
| 5,189,974 | 3/1993 | Masters | 114/61 |

*Primary Examiner*—Sherman Basinger

*Attorney, Agent, or Firm*—Gifford, Krass, Groh, Sprinkle, Patmore, Anderson & Citkowski, P.C.

[57] ABSTRACT

A water surface glide sailboat utilizing wind power propelling is disclosed wherein the sailboat includes a flat bottom float mounted on a beam at a joint having an axis parallel to the keel line of the sailboat so that the floats are further capable of rolling about the axis. The sailboat can be further equipped with a steering gear including a controlling stick connected to the joint so that the sailboat crew can control a flat bottom float and restrain the fluctuation of the flat bottom float to keep the parallel condition against water surface regardless of the heel of the boat and thereby decreasing the water resistances.

9 Claims, 5 Drawing Sheets

Fig - 1A
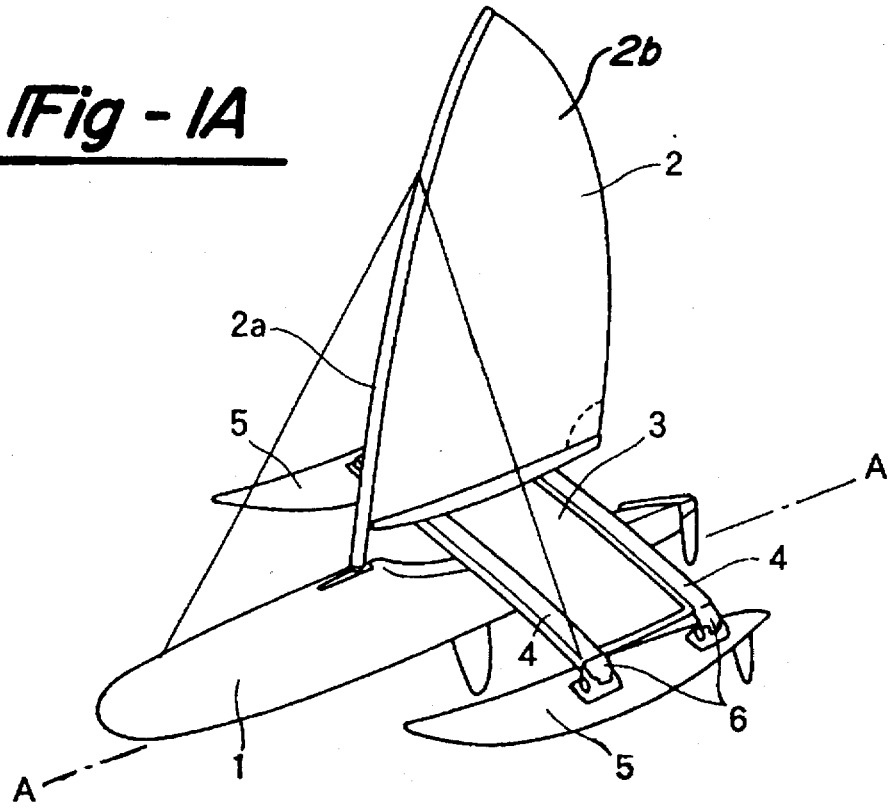
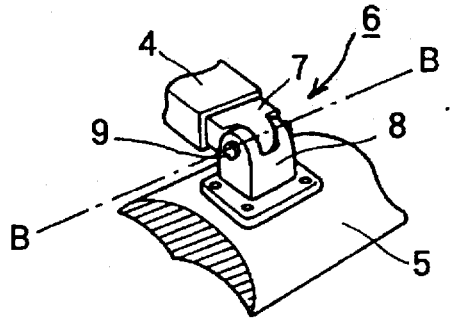
Fig - 1B
Fig - 1C
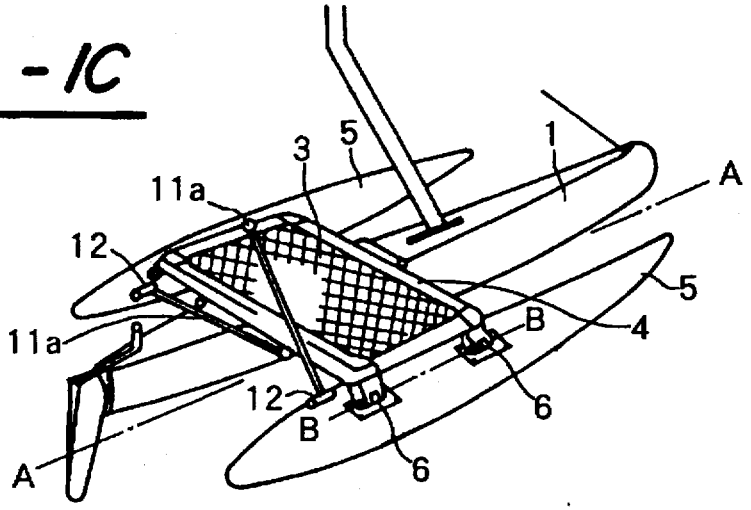

Fig - 2A
PRIOR ART
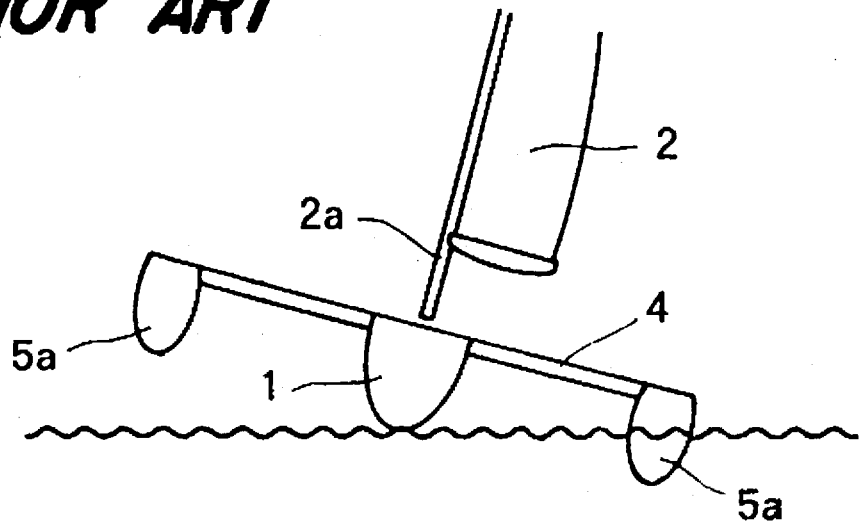
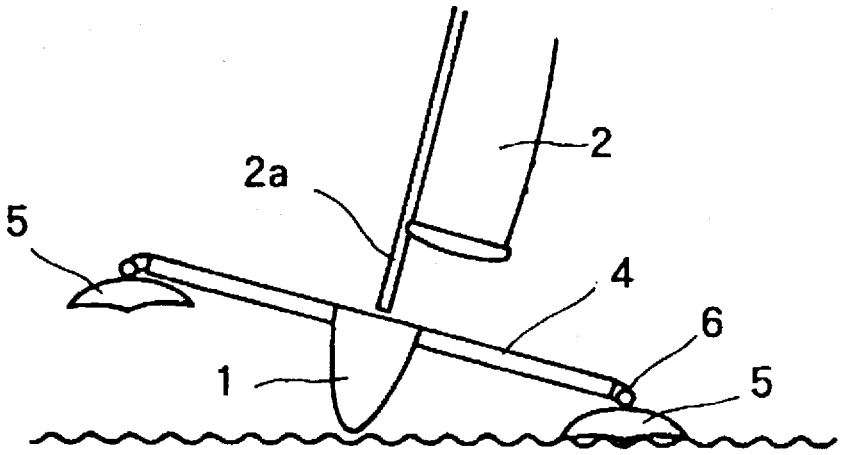
Fig - 2B

WATER SURFACE GLIDE SAILBOAT UTILIZING WIND POWER PROPELLING

This is a continuation of application Ser. No. 08/631,905 filed on Apr. 12, 1996, now abandoned which is a File Wrapper Continuation of Ser. No. 08/325,792 filed on Oct. 19, 1994 now abandoned.

BACKGROUND OF THE INVENTION

1. Field of the Invention

The present invention relates to water surface glide sailboats and in particular to water surface glide sailboats utilizing wind power propelling means and flat bottom floats.

2. Brief Description of the Prior Art

Conventional sailboats are depicted in FIGS. 6(*a*) and FIG. 6(*b*) of the attached drawings. FIG. 6(*a*) shows a sailboat including a main float 1, a wind power propelling member 2 consisting of a mast 2*a*, a sail 2*b*, a deck member 3, a beam 4 and draining-type float 5*a* fixed to the beam 4. FIG. 6(*b*) shows a variation of the sailboat shown in FIG. 6(*a*), without the main float 1.

Sailboats of the type depicted in FIGS. 6(*a*) and 6(*b*) are usually multihull sailboats comprising three floats as shown in FIG. 6(*a*) or two floats as shown in FIG. 6(*b*). Yet another sailboat is known in the art which is not shown in the figures. This third type of sailboat utilizes floats which are angular and variable in the longitudinal direction to prevent pitching of the sailboat. While such an angular float is adapted to prevent pitching, it does not adequately control rolling of the sailboat.

When the sails are before a fair wind, the sailboat has a tendency to lift out of the water or heel. Accordingly, when a conventional multihull sailboat heels, its float which are typically fixed to the beam, will also heel or lift out of the water. As a result, such a conventional multihull sailboat has difficulty sailing a flat bottom float horizontally on the water surface. Moreover, under rapid sail, a conventional sailboat of the draining type encounters various water resistances and must therefore be made more durable to avoid heeling. If the boat encounters water resistance and subsequently heels, the boat is more difficult to propel or "heavier".

SUMMARY OF THE INVENTION

The present invention relates to water surface glide sailboats propelled by wind power and having a flat bottom float mounted on a beam supporting a wind power propelling member. More particularly, the present invention relates to a flat bottom float which is mounted to enable rolling on the joint of the beam having an axis which is horizontal to the keel line of the sailboat. The present invention further relates to a rolling-control gear comprising a controlling stick which is connected to the joint so that the sailboat crew can control the rolling of the flat bottom float.

When a sailboat according to the present invention attains a predetermined water speed, the flat bottom float starts to sail and encounters various kinds of water resistances. The present invention decreases such water resistances against the float, thereby facilitating the glide sailing.

BRIEF DESCRIPTION OF THE DRAWINGS

FIGS. 1(*a*) through 1(*c*) are explanatory views of a first preferred embodiment of the present invention.

FIG. 1(*a*) is an external view of a first preferred embodiment.

FIG. 1(*b*) is a perspective view of a joint and FIG. 1(*c*) is a perspective view of searing gear controlling a flat bottom float as seen from a quarter back side.

FIG. 2 is an explanatory view which compares a sailboat according to the present invention with a convention sailboat.

FIG. 2(*a*) is a front view of a conventional multihull sailboat.

FIG. 2(*b*) is a front view of a water surface glide sailboat utilizing wind power propelling the first embodiment of the present invention.

DETAILED DESCRIPTION OF THE DRAWINGS

Figure 3A:
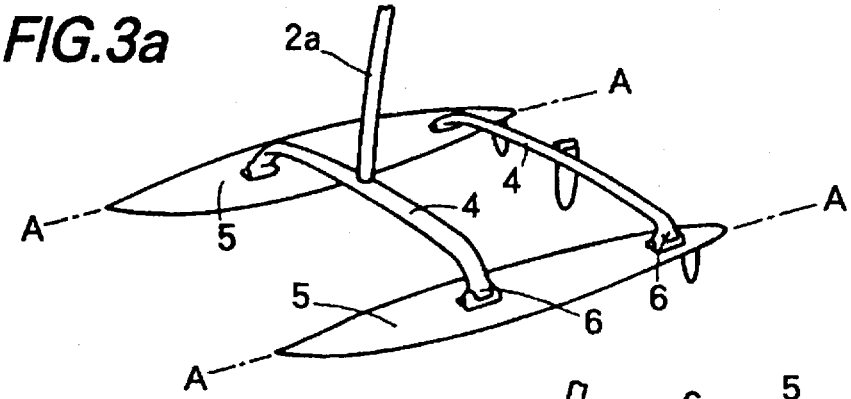
FIGS. 3(*a*) through 3(*d*) are external views which show each hull of a second preferred embodiment to a fifth preferred embodiment respectively of the present invention.
Figure 3B:
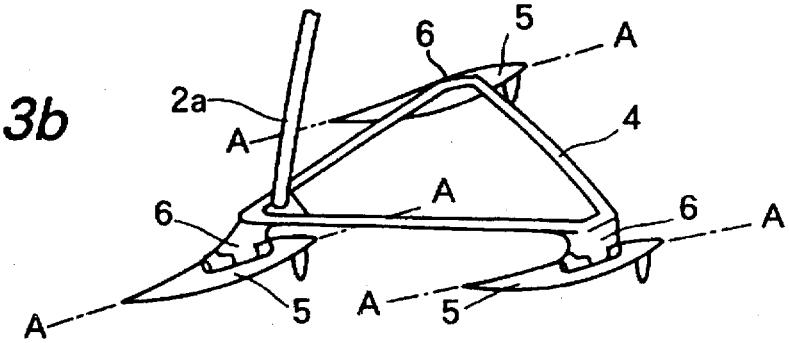
Figure 3C:
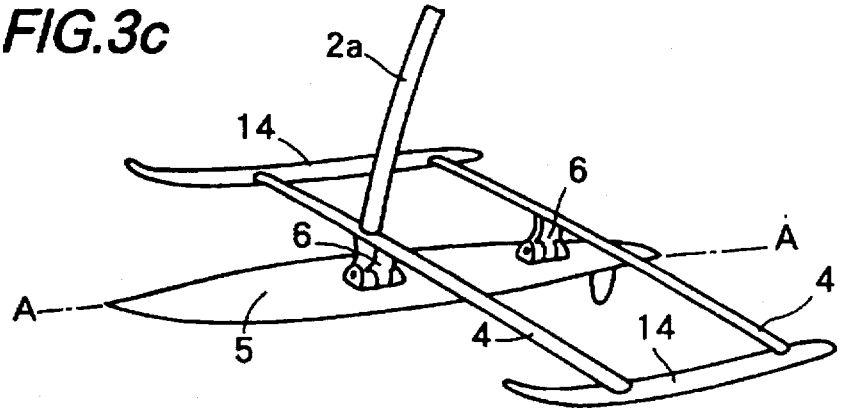
Figure 3D:
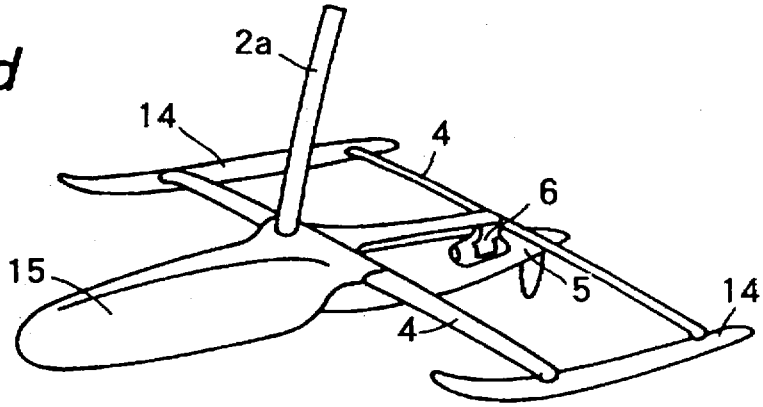

With reference to FIG. 1(*a*), a wind power propelled sailboat is depicted having a main float 1 and a wind power propelling member 2 mounted thereto. The wind power propelling member 2 includes a mast 2*a*, a sail or a wing 2*b*, a deck member 3 and a beam 4. A flat bottom float 5 is mounted on the beam 4 via joint 6. The main float 1 is a draining and slender ship-type float which is buoyant with respect to the weight of the sailboat and crew. The main float 1 performs as a conventional multihull sailboat does before the sailboat starts to glide, or sail by means other than glide sailing. The flat bottom float 5 has a very shallow V letter form for example, making it suitable for glide sailing and sailing stability. The mounting of the float 5 to the beam 4 is best shown in FIG. 1(*b*) wherein a joint member 7 is mounted to the beam 4 at beam side and is further pivotally joined to a joint member 8. The flat bottom float 5 is mounted to joint member 8 and the entire assembly pivots along the axis B—B. As is clear from comparing FIG. 1(*a*) and 1(*b*), axis B—B is parallel to the keel line of the boat shown in FIG. 1(*a*) as line A—A. Joint member 7 and joint member 8 are joined by a joint pin 9 along the axis B—B. With such an assembly, it is readily understood that the flat bottom float 5 is adapted to freely roll toward the beam 4. This enables the flat bottom float 5 to remain parallel with the water surface regardless of whether the sailboat heels.

FIG. 1(*c*) perhaps most clearly depicts a steering gear 11 which is mounted to a sailboat utilizing wind power propelling means such as the one shown in FIG. 1(*a*). A control stick 11(*a*) is pivotally mounted to the float 5 and is used by the crew to control the pivoting of the float 5 about the axis B—B. To achieve such rolling, control stick 11(*a*) is mounted to the float in the vicinity of joint 6. Through use of the control stick 11(*a*), the crew can change the course of the sailboat just like a surf boat, that is by controlling the rolling of the flat bottom float 5 by manipulating control stick 11(*a*). The use of the control stick 11(*a*) also enables the crew to control and reduce excessive fluctuations of the float 5.

Comparison Of the Present Invention with the Prior Embodiment

A comparison of the present invention with the prior embodiment is described by rear views as seen from the backside. When a conventional multihull sailboat heels, a float 5(*a*) also heels as is shown best in FIG. 2(*a*). On the other hand, in the case of a water surface glide sailboat according to the present invention (shown in FIG. 2(*b*)), the flat bottom float 5 of the sailboat is mounted on a beam 4 to enable the float 5 to roll on the axis B—B which is parallel to the keel line A—A of the sailboat. Thus, according to the present invention, the flat bottom float 5 is able to remain parallel to the water surface even if the keel of the sailboat heels.

Other Embodiments of the Present Invention

A second embodiment of the present invention is shown in FIG. 3(*a*) through FIG. 3(*d*). FIG. 3(*a*) depicts a two hulled catamaran or double hull sailboat having two flat bottom floats 5. The floats 5 are mounted parallel to each other and are further secured to beams 4 through joint 6 on an axis parallel to the keel line A—A of each float 5. The preferred embodiment shown in FIG. 3(*a*), is therefore adapted to decrease weight better than the first embodiment.

A third embodiment of the present invention is shown in FIG. 3(*a*) where three small flat bottom floats 5 are secured to beams 4 at a joint formed at each vertex of a triangle. Each joint is formed on an axis parallel to the keel line A—A of each float. According to this third embodiment, therefore, weight is decreased and hangaring and mobility are improved as compared to the second embodiment.

In yet a fourth embodiment, shown in FIG. 3(*c*), a single flat bottom float 5 is secured at the middle of two beams 4 by joints 6. Again, the joint 6 is parallel to the keel line A—A of the float 5. According to this preferred embodiment, two simple ski board-like floats 14 are mounted on both ends of beams 4 at each joint 6 to support a balanced sailing. A sailboat according to this embodiment, is easier to control as compared to the aforementioned embodiments and creates an effect as though surfboards were being used.

In a yet a fifth embodiment shown in FIG. 3(*d*), the bow of the center float of the fourth embodiment is secured to a beam 4 as a main float 15. The stern of the center float is also secured to another beam 4 at a joint 6 as a flat bottom float 5. The sailboat according to this embodiment offers a sense of control such as that provided by the fourth embodiment while performing similarly to the first embodiment.

Figure 4:
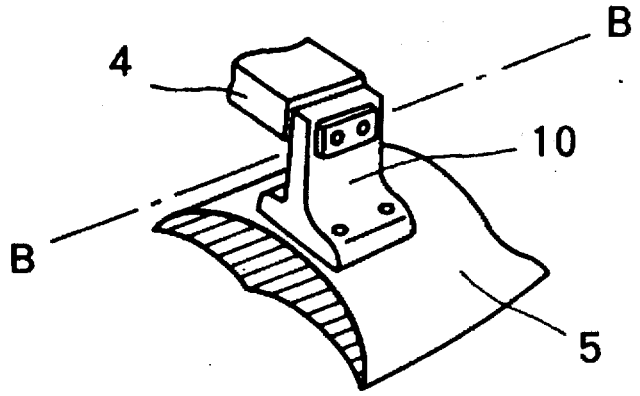
FIG. 4 is perspective view of another joint member of the present invention.

FIG. 4 shows a joint 10 composed of an elastomer-like rubber, plastic or other material mounted between the flat bottom float 5 and beam 4. The joint means for mounting the float to the beam in FIG. 4 functions the same as that shown in FIG. 1(*b*) where a joint pin 9 is used at joint 6 parallel to the keel line of the sailboat.

Figure 5:
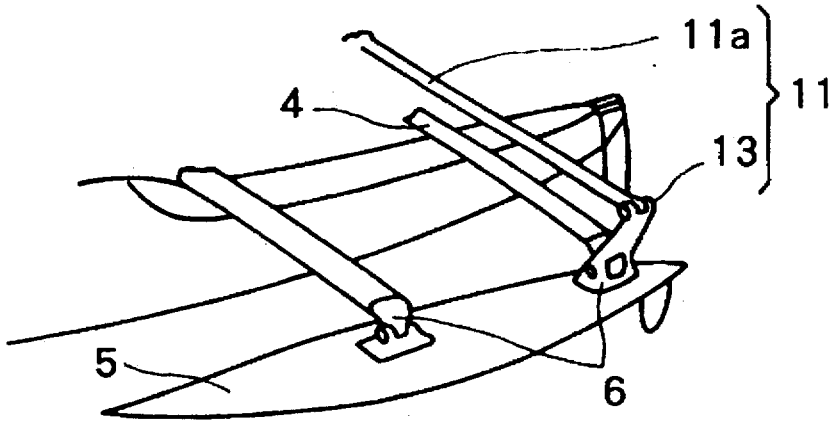
FIG. 5 is a perspective view which shows a steering gear of other flat bottom floats according to the present invention.
Figure 6A:
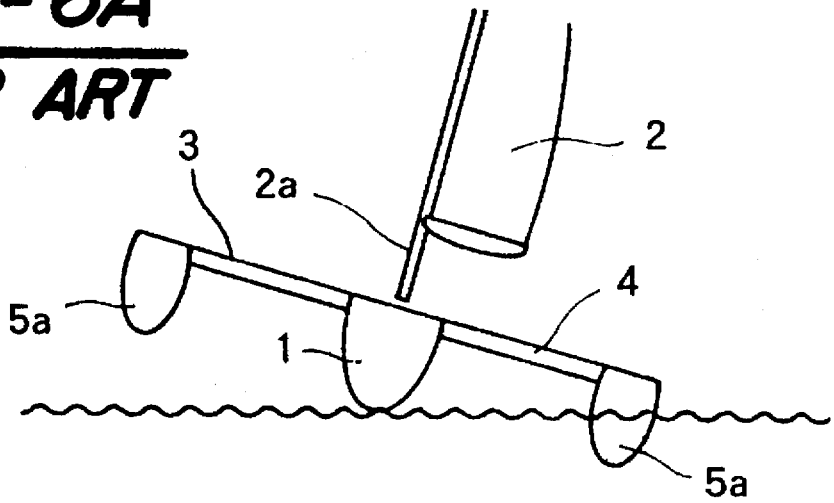
Fig - 6A PRIOR ART
FIGS. 6(*a*) and 6(*b*) are explanatory views showing conventional multihull sailboats.
Figure 6B:
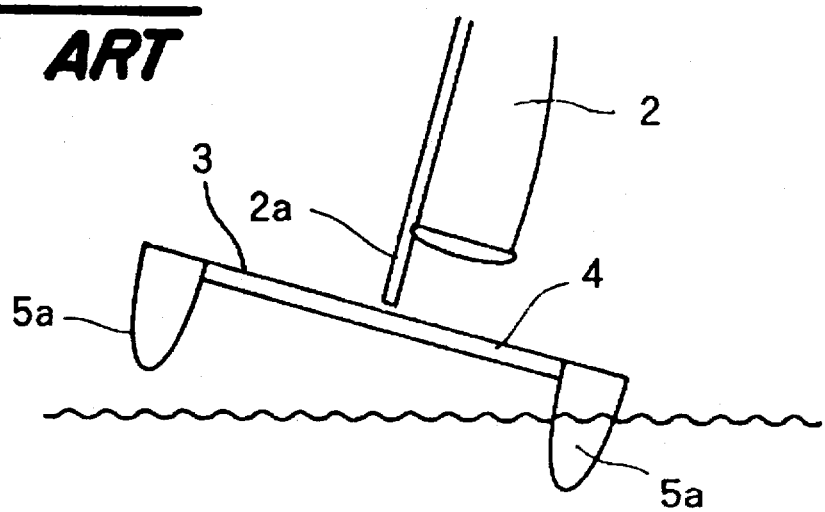
Fig - 6B PRIOR ART

FIG. 5 depicts a steering gear 11 of a flat bottom float which also functions the same as the control stick 11(*a*) although the controlling manners are reversed as compared to the controlling means which is shown in FIG. 1(*c*). Steering gear 11 is mounted to the hinge type joint 13 at the upper side position, extended from joint 6.

In short, the present invention provides a flat bottom float capable of remaining parallel with the water surface regardless of whether the sailboat heels and/or and the conditions of the water surface. Thus a sailboat according to the present invention improves the performance of glide sailing and allows the boat to attain high speed.

In addition, various kinds of water resistances are decreased by the present invention, thereby keeping the strength and rigidity of the sailboat within low levels, and consequently decreasing the weight of the sailboat accordingly.

Having described my invention herein I claim the following:

1. A water sailboat comprising:

a main float having a preset longitudinal length, a sail secured to and extending upwardly from said main float, an elongated beam, means for rigidly securing said beam to said main float so that one end of said beam extends laterally outwardly from one side of said main float and a second end of said beam extends laterally outwardly from the other side of said main float so that said beam and said main float pivot in unison with each other, a first elongated side float and a second elongated side float, said first and second side floats having a predetermined longitudinal length which is less than said preset longitudinal length of said main float, each float having a longitudinal center line and a substantially flat bottom surface, means for freely pivotally mounting said first side float to said one end of said beam so that said first side float is freely pivotal about an axis parallel to a longitudinal axis of said main float, said means for freely pivotally mounting said first side float to said beam being substantially vertically aligned with said center line of said first side float so that said bottom surface of said first side float remains parallel with an upper surface of the water despite heeling of the sailboat, and means for freely pivotally mounting said second side float to said second end of said beam so that said second side float is freely pivotal about an axis parallel to a longitudinal axis of said main float said means for freely pivotally mounting said second side float to said beam being substantially vertically aligned with said center line of said second side float so that said bottom surface of said second side float remains parallel with an upper surface of the water despite heeling of the sailboat.

2. The invention as defined in claim 1 wherein a rear end of said main float extends rearwardly of a rear end of said side floats and wherein a front end of said main float extends forwardly of a front end of said side floats.

3. The invention as defined in claim 1 wherein said side floats are substantially identical to each other.

4. The invention as defined in claim 1 wherein said side floats are equidistantly laterally spaced from said main float.

5. The invention as defined in claim 1 and comprising an elongated control stick having one end attached to one of said side floats and a second end accessible from said main float.

6. The invention as defined in claim 1 wherein a longitudinal axis of said side floats are substantially parallel to each other and to a longitudinal axis of said main float.

7. The invention as defined in claim 1 wherein a bottom surface of said side floats is substantially V-shaped in cross section.

8. The invention as defined in claim 1 wherein said means for pivotally mounting said side floats to said beam each comprises a hinge.

9. The invention as defined in claim 8 wherein said hinge comprises an elastomeric hinge.

* * * * *